US005115940A

United States Patent [19]

Friedman

[11] Patent Number: 5,115,940

[45] Date of Patent: May 26, 1992

[54] CONTAINER COOLER APPARATUS

[76] Inventor: Todd A. Friedman, 52 Cherry St., Willow Grove, Pa. 19090

[21] Appl. No.: 742,375

[22] Filed: Aug. 8, 1991

[51] Int. Cl.[5] ..... F25D 3/08; F25D 3/10

[52] U.S. Cl. ..... 220/737; 220/741; 220/94 A; 220/903; 62/371; 62/457.1; 62/457.9

[58] Field of Search ..... 62/293, 294, 371, 459.1, 62/459.7; 220/737, 739, 741, 94 A, 903, 426, 427

[56] References Cited

U.S. PATENT DOCUMENTS

| | | | |
|---|---|---|---|
| 2,805,556 | 9/1957 | Wang | 62/457.9 |
| 2,900,808 | 8/1959 | Wang | 62/457.9 |
| 3,302,428 | 2/1967 | Stoner et al. | 62/371 |
| 3,862,548 | 1/1975 | Ladany | 62/294 |
| 3,995,445 | 12/1976 | Huskins | 62/371 |
| 4,054,037 | 10/1977 | Yoder | 62/294 |
| 4,163,374 | 8/1979 | Moore et al. | 220/737 |
| 4,383,422 | 5/1983 | Gordon et al. | 220/410 |
| 4,638,645 | 1/1987 | Simila | 62/371 |
| 4,640,101 | 2/1987 | Johnson | 62/294 |
| 4,958,501 | 9/1990 | Nakano et al. | 62/294 |

*Primary Examiner*—Stephen P. Garbe
*Assistant Examiner*—S. Castellano
*Attorney, Agent, or Firm*—Leon Gilden

[57] ABSTRACT

A container cooler includes a support housing formed with a cylindrical interior cavity in communication with a handle mounted to the container. A pressurized gas container is mounted within the handle, with a lever member operatively mounted to the handle to effect selective directing of pressurized gas through the handle into the cavity to effect selective cooling of the beverage container mounted within the housing cavity.

4 Claims, 5 Drawing Sheets

CONTAINER COOLER APPARATUS

BACKGROUND OF THE INVENTION

1. Field of the Invention

The field of invention relates to container cooling structure, and more particularly pertains to a new and improved container cooler apparatus wherein the same is arranged to selectively direct pressurized gas such as carbon dioxide into surrounding relationship relative to a beverage container mounted within the cooler apparatus to effect selective cooling thereof.

2. Description of the Prior Art

Portable beverage cooler apparatus is generally of an enlarged and expansive construction to accommodate a plurality of beverage containers therewithin. A need is dictated in the art to provide a convenient, compact, and readily portable structure to effect selective cooling of a single beverage container. Examples of prior art structure is found in U.S. Pat. No. 4,054,037 to Yoder for example, wherein a pressurized refrigerant is directed from a container into an associated beverage container secured within an enclosed housing.

U.S. Pat. No. 3,862,548, to Ladany sets forth a device for cooling liquids, wherein the device includes a punch member to effect discharge of a gas within a quantity of fluid to effect cooling thereof.

U.S. Pat. No. 4,640,102 to Tenenbaum, et al. sets forth a container for cooling beverages, wherein a capsule is positioned within the container for cooling of the fluid therewithin.

U.S. Pat. No. 4,679,407 to Kim, et al. sets forth a beverage container formed with an enclosed cooling means that is selectively opened to pressure liquid cooling agents to immediately cool contents of the container.

As such, it may be appreciated that there continues to be a need for a new and improved container cooler apparatus as set forth by the instant invention which addresses both the problems of ease of use as well as effectiveness in construction and in this respect, the present invention substantially fulfills this need.

SUMMARY OF THE INVENTION

In view of the foregoing disadvantages inherent in the known types of cooling apparatus now present in the prior art, the present invention provides a container cooler apparatus wherein the same selectively mounts a single container within a housing and effects release of a pressurized gas from an associated refrigerant container to effect selective cooling of the beverage container. As such, the general purpose of the present invention, which will be described subsequently in greater detail, is to provide a new and improved container cooler apparatus which has all the advantages of the prior art container cooler apparatus and none of the disadvantages.

To attain this, the present invention provides a container cooler including a support housing formed with a cylindrical interior cavity in communication with a handle mounted to the container. A pressurized gas container is mounted within the handle, with a lever member operatively mounted to the handle to effect selective directing of pressurized gas through the handle into the cavity to effect selective cooling of the beverage container mounted within the housing cavity.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the Public generally, and especially the scientists, engineers and Practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved container cooler apparatus which has all the advantages of the prior art container cooler apparatus and none of the disadvantages.

It is another object of the present invention to provide a new and improved container cooler apparatus which may be easily and efficiently manufactured and marketed.

It is a further object of the present invention to provide a new and improved container cooler apparatus which is of a durable and reliable construction.

An even further object of the present invention is to provide a new and improved container cooler apparatus which is susceptible of a low cost of manufacture with regard to both materials and labor, and which accordingly is then susceptible of low prices of sale to the consuming public, thereby making such container cooler apparatus economically available to the buying public.

Still yet another object of the present invention is to provide a new and improved container cooler apparatus which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such Description makes reference to the annexed drawings wherein.

DESCRIPTION OF THE PREFERRED EMBODIMENT

Figures 1, 2:
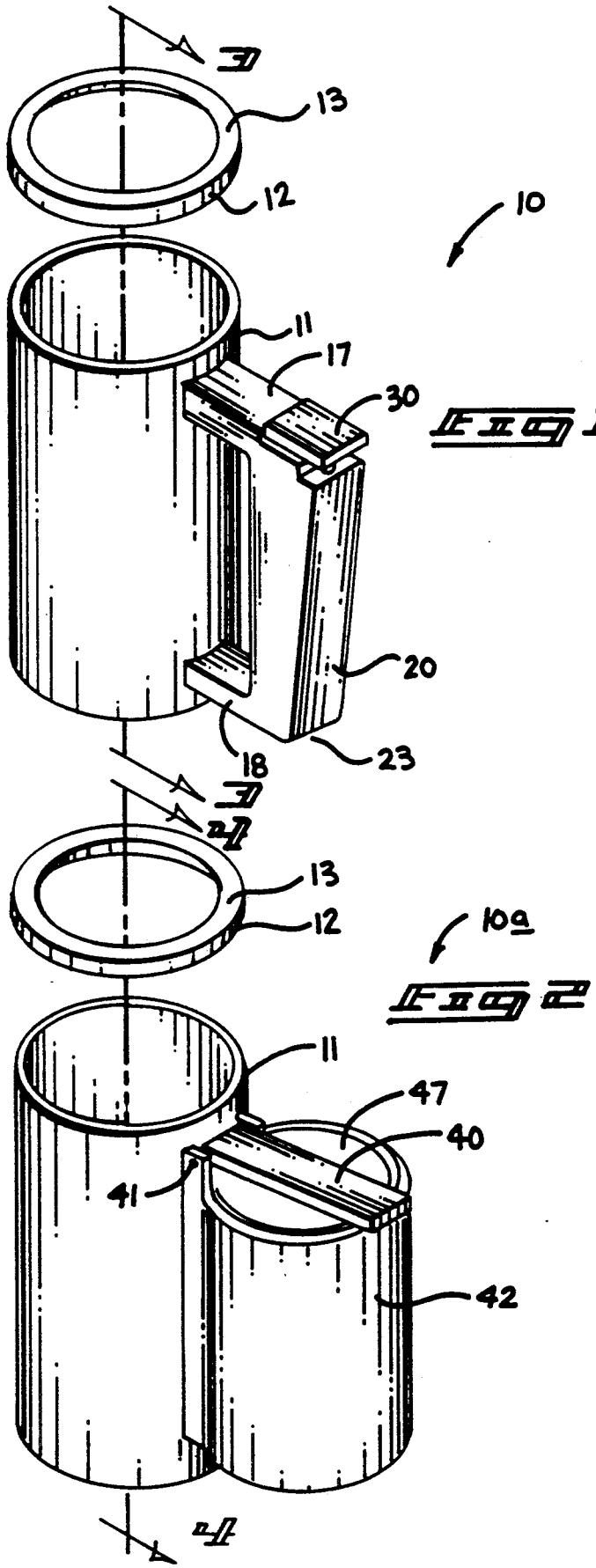
FIG. 1 is an isometric illustration of the instant invention.
FIG. 2 is an isometric illustration of a modification of the invention.
Figure 3:
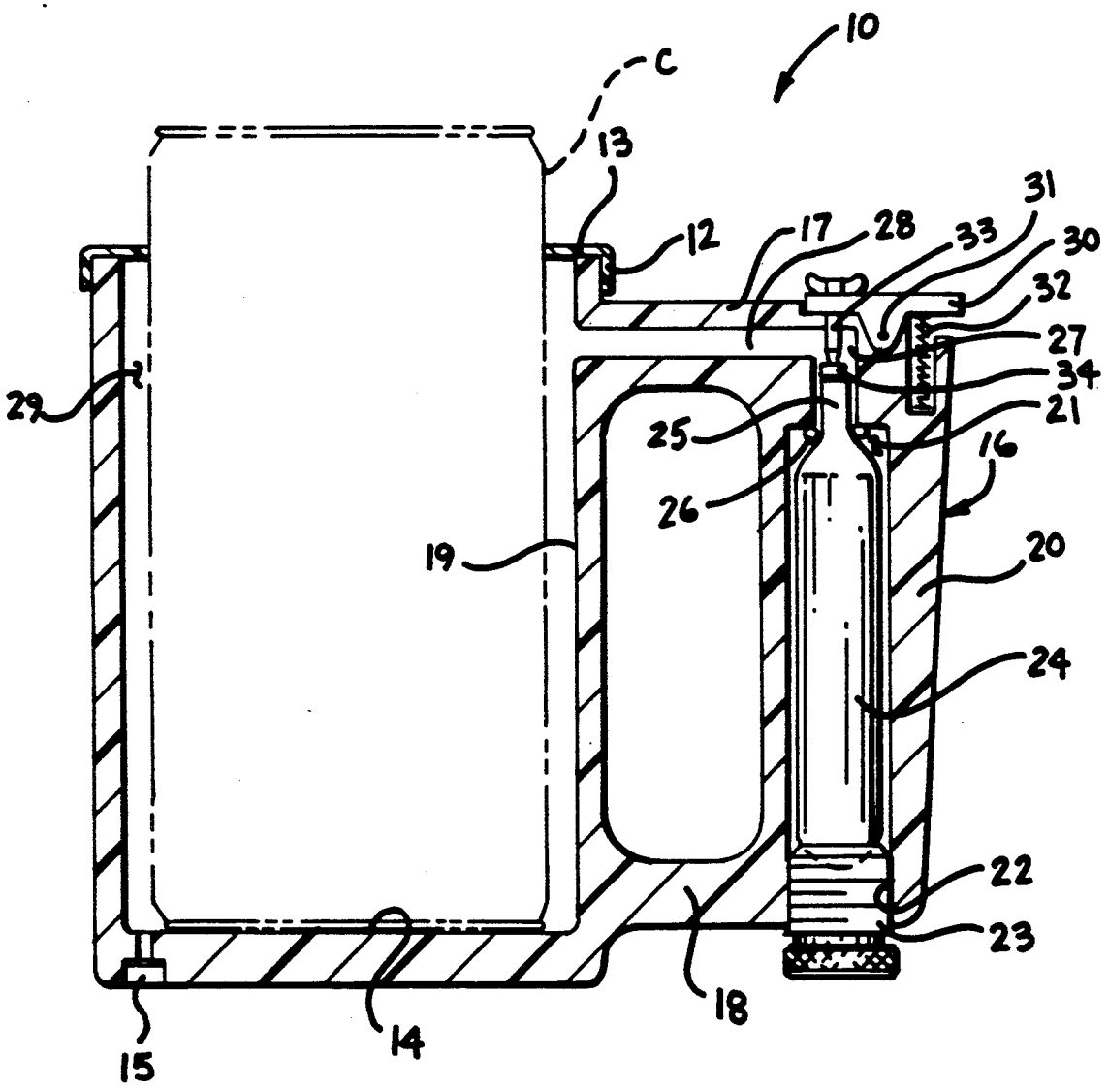
FIG. 3 is an orthographic view, taken along the lines 3—3 of FIG. 1 in the direction indicated by the arrows.

With reference now to the drawings, and in particular to FIGS. 1 to 8 thereof, a new and improved container cooler apparatus embodying the principles and concepts of the present invention and generally designated by the reference numerals 10 and 10*a* Will be described.

More specifically, the container cooler apparatus 10 of the instant invention essentially comprises a cylindrical support housing 11, with the cylindrical housing 11 including an upper annular end receiving a cylindrical cap 12 thereon. The cylindrical cap includes an annular polymeric sealing ring 13 projecting radially and interiorly of the cap 12 to effect a sealing relationship between the cap and a beverage container "C" positioned Within the cylindrical cavity 29 of the housing 11. The cylindrical support housing 11 includes a housing interior cylindrical wall 19, and a housing floor 14 containing a relief valve 15 therewithin to permit expelling and discharge of the gas in surrounding relationship relative to the beverage container "C" once the gas has circulated in communication between the interior Wall 19 and the beverage container "C".

A "U" shaped rigid handle 16 is mounted to an exterior surface of the cylindrical housing 11 and includes a top handle leg 17 spaced from a bottom handle leg 18, with a handle protecting leg 20 mounted to outer terminal ends of the top and bottom handle legs 17 and 18. The handle connecting leg 20 includes a leg chamber 21, including an internal threaded opening 22 directed through a lower terminal end of the connecting leg 20 that is internally threaded and receives an internally threaded plug 23 therewithin. A pressurized refrigerant cylinder 24 typically containing compressed carbon dioxide gas is positioned within the leg chamber 21 and includes cylinder neck 25 received medially of a cylindrical seal 26 mounted to an upper terminal end of the leg chamber 21. A first gas conduit 27 is in communication with the leg chamber 21, wherein the first gas conduit 27 is thereafter in communication with a second gas conduit 28 in communication with the container cylindrical cavity 29. A lever member 30 pivotally mounted medially of the lever ember 30 about a fulcrum axle 31 includes a spring member 32 received within a spring member socket 32*a* that is formed within the upper portion of the connecting leg 20 and under a rear portion of the lever member 30 biases a forward end of the lever member 30 downwardly, wherein a piercing rod 33 is threadedly received through a forward portion of the lever member on an opposed side of the fulcrum axle 31 relative to the spring member 32. The piercing rod 33 includes a sealing plug 34 formed at a lower terminal end thereof, whereupon typical biasing of the forward end of the lever member downwardly effects selective sealing within the neck 25 of the refrigerant cylinder 24.

Figure 7:
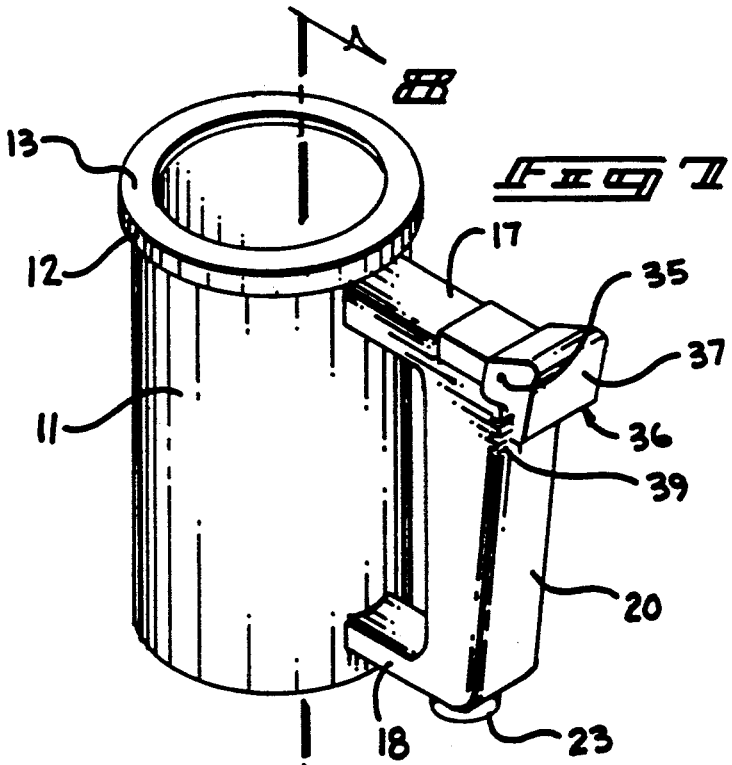
FIG. 7 is an isometric illustration of a modified handle structure of the container as set forth in FIG. 1.
Figure 8:
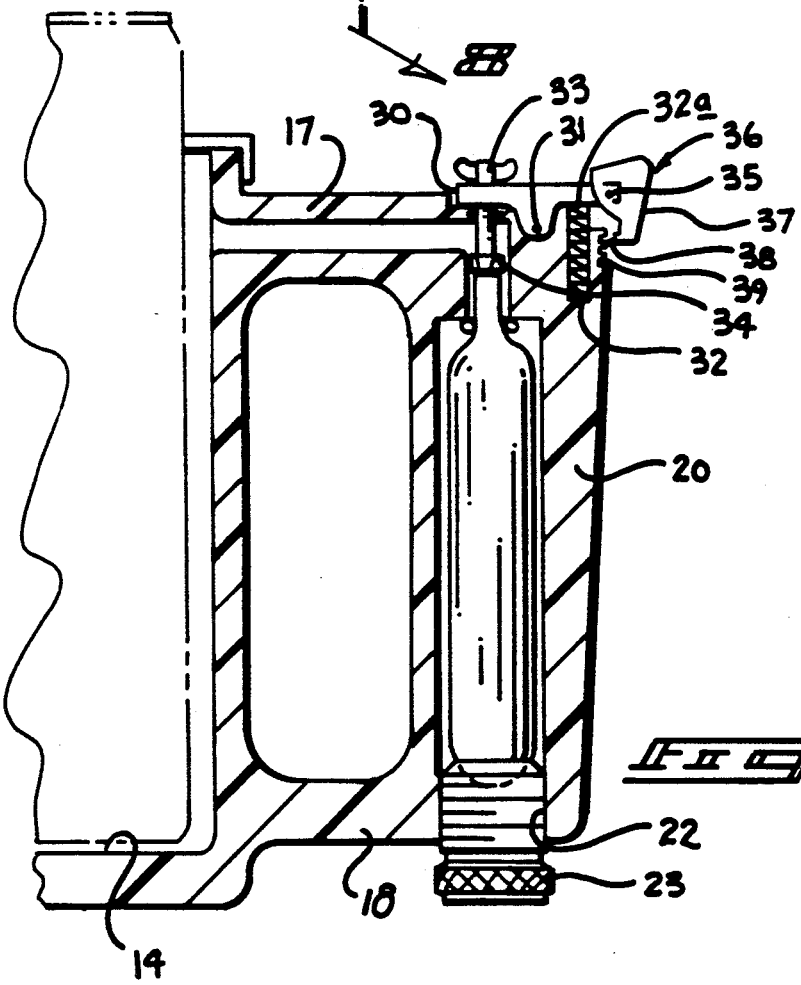
FIG. 8 is an orthographic view, taken along the lines 8—8 of FIG. 7 in the direction indicated by the arrows.

Reference to FIGS. 7 and 8 illustrates a rear lever pivot axle 35 directed through a rear portion of the lever 30 rearwardly of the fulcrum axle 31, and includes a lever locking cap 36 pivotally mounted about the rear lever pivot axle 35. A cap projection 37 is directed downwardly from the cap 36 and includes a projection leg 38 orthogonally oriented relative to the cap projection projecting into a rear surface of the connecting leg 30 that includes a row of toothed elements 39 to thereby permit selective latching of the lever 30 in a downward orientation to provide selective and continuous flow of refrigerant into the container cylindrical cavity 29 through the respective first and second gas conduits 27 and 28.

Figure 4:
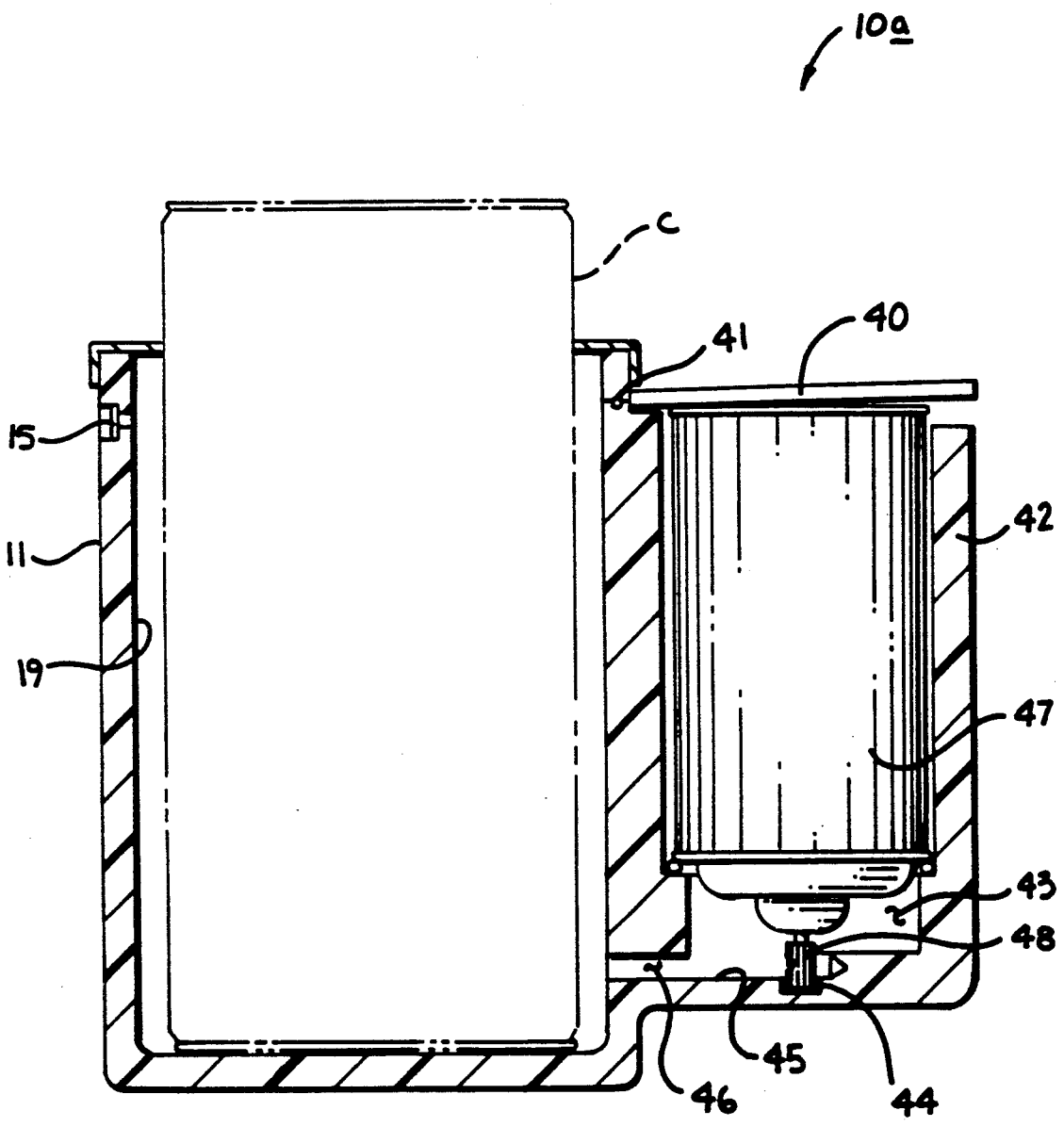
FIG. 4 is an orthographic view, taken along the lines 4—4 of FIG. 2 in the direction indicated by the arrows.
Figure 5:
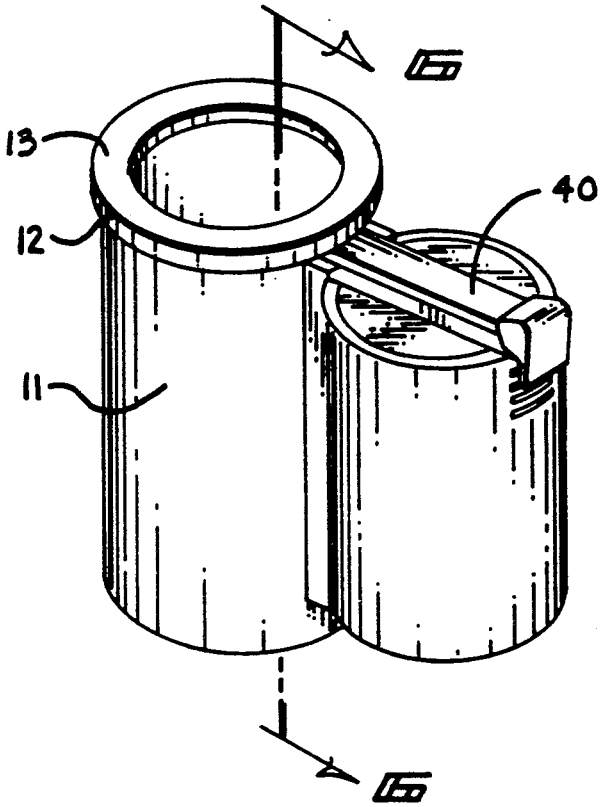
FIG. 5 is an isometric illustration of a modified handle structure of the container as set forth in FIG. 2.
Figure 6:
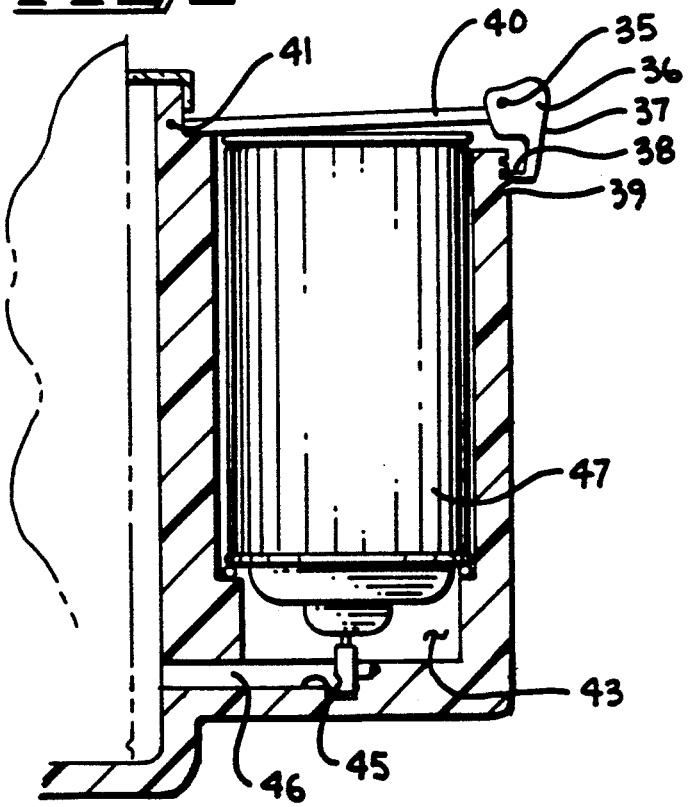
FIG. 6 is an orthographic view, taken along the lines 6—6 of FIG. 5 in the direction indicated by the arrows.

The container cooler apparatus 10*a*, as illustrated in FIG. 2, utilizes a lever plate 40 mounted about a lever plate pivot 41 formed to a forward portion of a cylindrical handle 42 that includes a handle cavity 43 receiving aerosol refrigerant containers 47. The handle cavity 43 includes a central recess 44 directed medially of a cavity floor 45 to receive a spray head 48, as illustrated in FIG. 4. Depressing of the lever 40 effects directing of refrigerant through the first conduit 46 into the associated container cylindrical cavity 29. As illustrated in FIGS. 5 and 6, the lever locking cap 36 is pivotally mounted to a rear terminal end of the lever plate 40, in a manner as discussed above, to effect selective latching of the lever plate in a downward orientation.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected be letters patent of the United States is as follows:

1. A container cooler apparatus, comprising, a cylindrical support housing, the cylindrical support housing including a housing upper annular end, wherein the upper annular end slidably receives a cylindrical cap in surrounding relationship relative to the upper annular end, and the cylindrical cap includes an annular polymeric sealing ring projecting radially and interiorly of the cylindrical cap, and the cylindrical support housing including a housing floor, a pressure relief valve mounted within the housing floor, and a "U" shaped handle fixedly mounted to an exterior surface of the support housing, the "U" shaped handle including a top handle leg spaced from a bottom handle leg, and a handle connecting leg mounted fixedly and between the top handle leg and the bottom handle leg, and the handle connecting leg including a leg chamber, the leg chamber including a refrigerant cylinder mounted therewithin, and at least one gas conduit interconnecting the leg chamber, with an interior surface of the support housing, and a level member means pivotally mounted to the top handle leg for effecting selective refrigerant flow from the refrigerant cylinder through the at least one gas conduit into the support housing.

2. An apparatus as set forth in claim 1 wherein the lever member means includes a lever member that includes a fulcrum axle directed medially thereof pivotally mounting the ever member to the top handle leg, and a spring member in biased communication to a rear surface of the lever member, the spring member contained within a spring member socket, the spring member socket positioned within an upper portion of the handle connecting leg.

3. An apparatus as set forth in claim 2 wherein the lever member includes a piercing rod threadedly directed through the lever member through a forward end thereof spaced from the fulcrum axle and the spring member, wherein the piercing rod is projected through the at least one gas conduit into the refrigerant cylinder, and the piercing rod includes a seal plug in surrounding relationship relative to the piercing rod and is positioned below the lever member to effect selective sealing of refrigerant within the refrigerant cylinder during normal biasing of the spring member against the lever member.

4. An apparatus as set forth in claim 3 including a rear lever pivot axle pivotally mounted through a rear end portion of the lever member spaced from the spring member and the fulcrum axle, the rear lever pivot axle including a lever locking cap pivotally mounting the lever locking cap about the rear end portion of the lever member, and the lever locking cap including a cap projection extending downwardly along a rear surface of the handle connecting leg, and the handle connecting leg including a series of spaced toothed elements, and the cap projection including a projecting leg orthogonally oriented relative to the cap projection selectively positioned within one of said toothed elements to effect selective pivoting of the lever member relative to the top handle leg.

* * * * *